US008882640B2

(12) United States Patent
Yeh

(10) Patent No.: US 8,882,640 B2
(45) Date of Patent: Nov. 11, 2014

(54) TREADMILL

(76) Inventor: Yung-Sung Yeh, New Taipei (TW)

( * ) Notice: Subject to any disclaimer, the term of this patent is extended or adjusted under 35 U.S.C. 154(b) by 292 days.

(21) Appl. No.: 13/588,201

(22) Filed: Aug. 17, 2012

(65) Prior Publication Data

US 2013/0079198 A1 Mar. 28, 2013

(30) Foreign Application Priority Data

Sep. 28, 2011 (TW) ..... 100218137 U
Oct. 5, 2011 (TW) ..... 100218649 U

(51) Int. Cl.

| | |
|---|---|
| ***A63B 22/02*** | (2006.01) |
| ***A63B 21/22*** | (2006.01) |
| ***A63B 21/055*** | (2006.01) |
| ***A63B 21/015*** | (2006.01) |
| ***A63B 21/00*** | (2006.01) |
| *A63B 22/00* | (2006.01) |

(52) U.S. Cl.

CPC ..... *A63B 21/0552* (2013.01); *A63B 21/225* (2013.01); *A63B 2022/0053* (2013.01); *A63B 21/015* (2013.01); *A63B 22/0056* (2013.01); *A63B 21/00069* (2013.01)

USPC ..... 482/54; 482/51; 482/52

(58) Field of Classification Search

CPC ..... A63B 33/001; A63B 33/0007; A63B 33/0012; A63B 33/0015

USPC ..... 482/51–54, 57, 61, 79, 80, 908

See application file for complete search history.

(56) References Cited

U.S. PATENT DOCUMENTS

| | | | | |
|---|---|---|---|---|
| 5,013,031 | A * | 5/1991 | Bull | 482/52 |
| 5,733,227 | A * | 3/1998 | Lee | 482/52 |
| 6,997,854 | B2 * | 2/2006 | Yang | 482/53 |
| 8,051,752 | B2 * | 11/2011 | Murray et al. | 82/52 |
| 2004/0005960 | A1 * | 1/2004 | Chang | 482/52 |
| 2007/0197345 | A1 * | 8/2007 | Wallace et al. | 482/8 |
| 2008/0146417 | A1 * | 6/2008 | Chang | 482/70 |
| 2011/0071005 | A1 * | 3/2011 | Lai | 482/52 |

* cited by examiner

*Primary Examiner* — Loan H Thanh
*Assistant Examiner* — Nyca T Nguyen
(74) *Attorney, Agent, or Firm* — Egbert Law Offices, PLLC

(57) ABSTRACT

An improved treadmill includes a pedestal, arm stand, drag wheel, two swinging rods and pedals, a stride regulating mechanism, and two elbow-type drive connecting rods. The arm stand is set vertically onto the pedestal's mounting surface. The drag wheel is pivoted axially onto the pedestal through a vertical framework. A mandrel is set transversely onto the center of the drag wheel. Two swinging rods have the pivotal end pivoted onto the pedestal and located at a spacing on two sides of the drag wheel. Two pedals are separately set onto the swinging ends of two swinging rods. Two elbow-type drive connecting rods are linked separately to the mandrel and two swinging rods of the drag wheel, and the stride regulating mechanism is set between two swinging rods. The treadmill has less driving members, lower manufacturing and assembly cost and better driving performance.

3 Claims, 6 Drawing Sheets

TREADMILL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a treadmill device, and more particularly to an innovative one which is designed to adjust the stride with satisfactory driving performance.

2. Description of Related Art Including Information Disclosed Under 37 CFR 1.97 and 37 CFR 1.98.

A treadmill is structurally designed in a way that the left/right foot levers are linked to the drag wheel via a driving mechanism. When the left and right foot levers move vertically along with the left and right pedals, the drag wheel is driven to rotate for proper drag effect in combination with a preset resistance device (e.g.: magnetic).

According to the treadmills currently available, the driving mechanism set between left/right foot levers and the drag wheel is steel rope-operated. However, the following shortcomings are observed during actual applications:

The steel rope-operated model is restricted by its gravity drive structure, so a two-stage drive pattern must be designed to reach the desired gravity state. Yet, this will likely lead to higher cost and bigger difficulty in assembly as well as other shortcomings such as: a slippery belt, falling-off, off-tracking, breakage or overturning.

The treading range (i.e. an included angle from maximum to minimum swinging angle of the pedal) of conventional treadmills' left and right pedals is fixed. Given various leg length of different users, the difficulty and comfort in treading may vary. In such a case, if users cannot adjust the actuating range of left and right pedals, the diversified users and their demands could not be met by conventional treadmills.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the unique structural design of the present invention wherein "an improved structure of treadmill" allows two drive connecting rods to be linked to the mandrel and two swinging rods of the drag wheel on the pedestal, and a stride regulating mechanism is set on the pedestal between two swinging rods, the regulating member of the stride regulating mechanism could thus regulate or change the lifting state of the lifting base, so as to change the height of the free wheel and double-end pull rope for regulating two swinging rods along with maximum stride of two pedals. Moreover, the front elbow of the drive connecting rod is formed into a curved pattern, the swinging angle of the front elbow is of a back rake angle without exceeding vertical angle, so as to avoid dead point for driving and guarantee more smooth operation. With use of leverage principle, the force formed by the drive connecting rod permits to reach the desired action of gravity and drive the drag wheel, without need of a belt structure. With this design, the present invention could dramatically reduce the driving members and failure, cut down the cost in manufacturing and assembly, and improve the driving performance for different users with better applicability and industrial benefits.

Although the invention has been explained in relation to its preferred embodiment, it is to be understood that many other possible modifications and variations can be made without departing from the spirit and scope of the invention as hereinafter claimed.

BRIEF DESCRIPTION OF THE SEVERAL VIEWS OP THE DRAWINGS

DETAILED DESCRIPTION OF THE INVENTION

Figure 1:
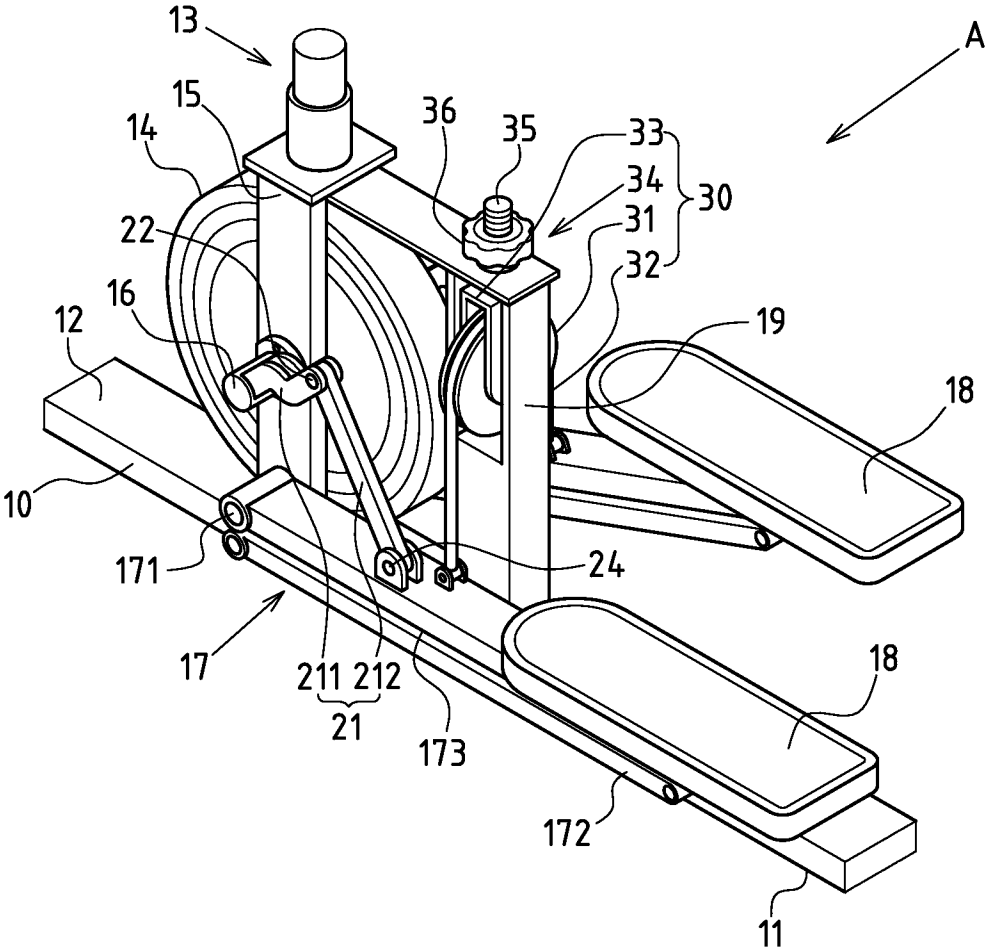
FIG. 1 is an assembled perspective view of the internal structure of the treadmill of the present invention.

FIGS. 1-9 depict preferred embodiments of an improved treadmill of the present invention, which, however, are provided for only explanatory objective for patent claims.

Said treadmill A comprises a pedestal 10, set transversely in an elongated pattern, including: a holding portion 11 and mounting surface 12.

An arm stand 13 is set vertically onto the mounting surface 12 of the pedestal 10.

A drag wheel 14 is pivoted axially onto the pedestal 10 through a vertical framework 15. A mandrel 16 is set transversely onto the center of the drag wheel 14.

Two swinging rods 17 and two pedals 18 are provided. Of which, two swinging rods 17 include a pivotal end 171, a swinging end 172 and a middle portion 173 located between the pivotal end 171 and swinging end 172. The pivotal end 171 is pivoted onto the pedestal 10 and located at a spacing on two sides of the drag wheel 14. Moreover, the pivoting location of the pivotal end 171 corresponds to the lower position of the mandrel 16 at center of the drag wheel 14. Two pedals 18 are separately set onto the swinging ends 172 of two swinging rods 17. Moreover, a floorstand 19 is set on said pedestal 10 between two swinging rods 17.

A stride regulating mechanism 30 is set onto the floorstand 19, comprising of a free wheel 31, a double-end pull rope 32, a lifting base 33 and a regulating member 34. Of which, the double-end pull rope 32 is hung onto the free wheel 31 in a U shape, and two ends of the double-end pull rope 32 are separately attached to the middle portion 173 of two swinging rods 17. The free wheel 31 is pivoted onto the lifting base 33 in a rotary state; and the lifting base 33 is suspended onto the floorstand 19 through the regulating member 34.

Two elbow-type drive connecting rods 21 are linked separately to the mandrel 16 and two swinging rods 17 of the drag wheel 14. Said drive connecting rod 21 comprises of a front elbow 211 and a rear elbow 212. The front elbow 211 and rear elbow 212 are coupled via a pivoted portion 22. Moreover, a one-way bearing sleeving portion is set at front end of the front elbow 211 for sleeving onto the mandrel 16 of the drag wheel 14. The rear end of the rear elbow 212 is provided with a rear pivoted portion 24 linked to the middle portion 173 of the swinging rod 17. When two swinging rods 17 swing vertically, the front and rear elbows 211,212 of the drive connecting rod 21 are driven for inching movement with varying included angle. Furthermore, the drag wheel 14 is rotated under one-way drive of the one-way bearing sleeving portion 23 (only marked in FIG. 7) for the mandrel 16.

Figure 2:
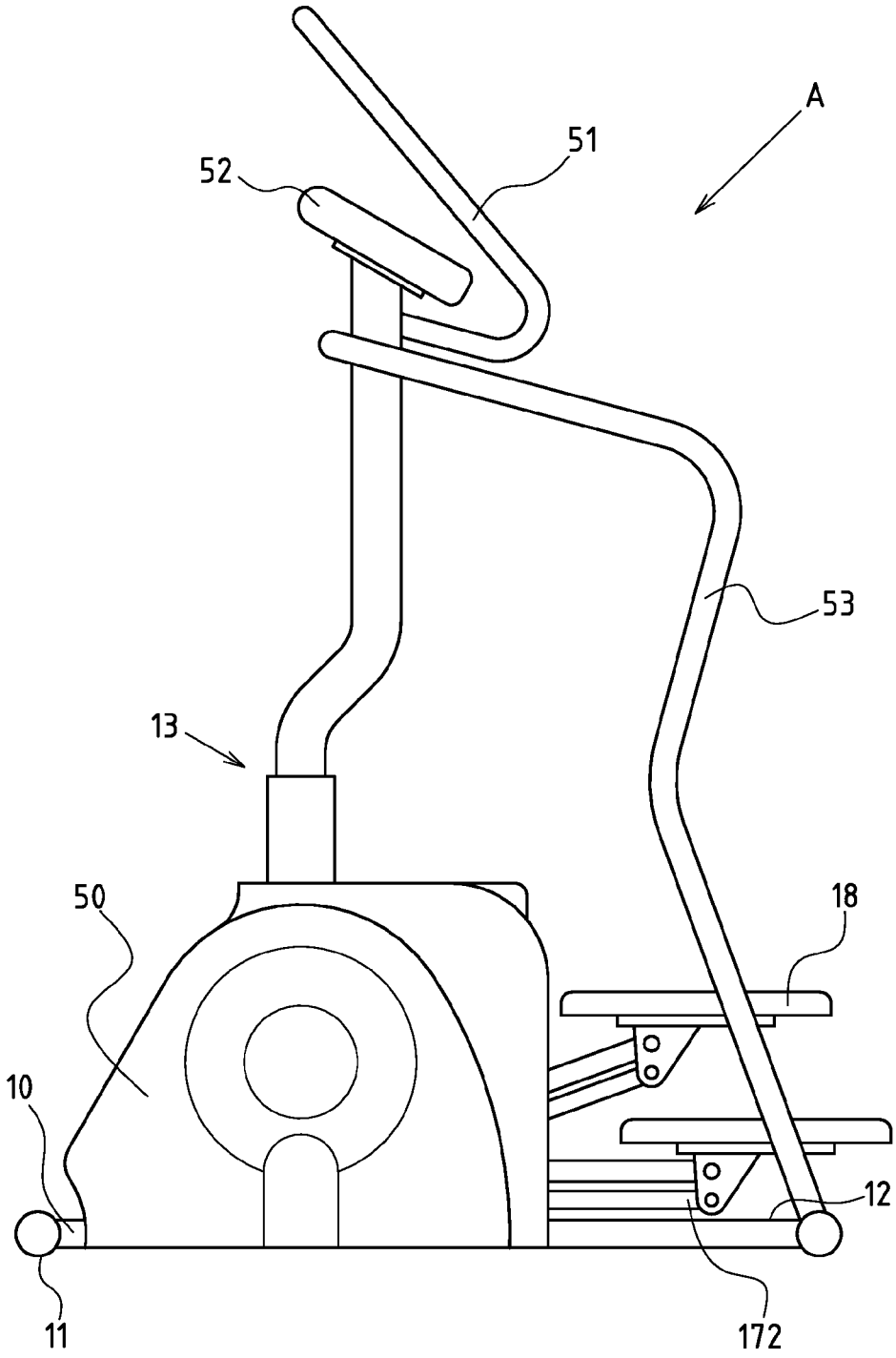
FIG. 2 is a plane side view of the treadmill of the present invention.

FIG. 2 depicts an application view of the treadmill incorporated in the present invention, wherein the treadmill A comprises: a pedestal 10, two pedals 18, a housing 50, an armrest 51, a control panel 52 and a frame 53. The present invention is mounted into the housing 50, allowing for vertical swinging motion by treading the pedals 18.

Figure 8:
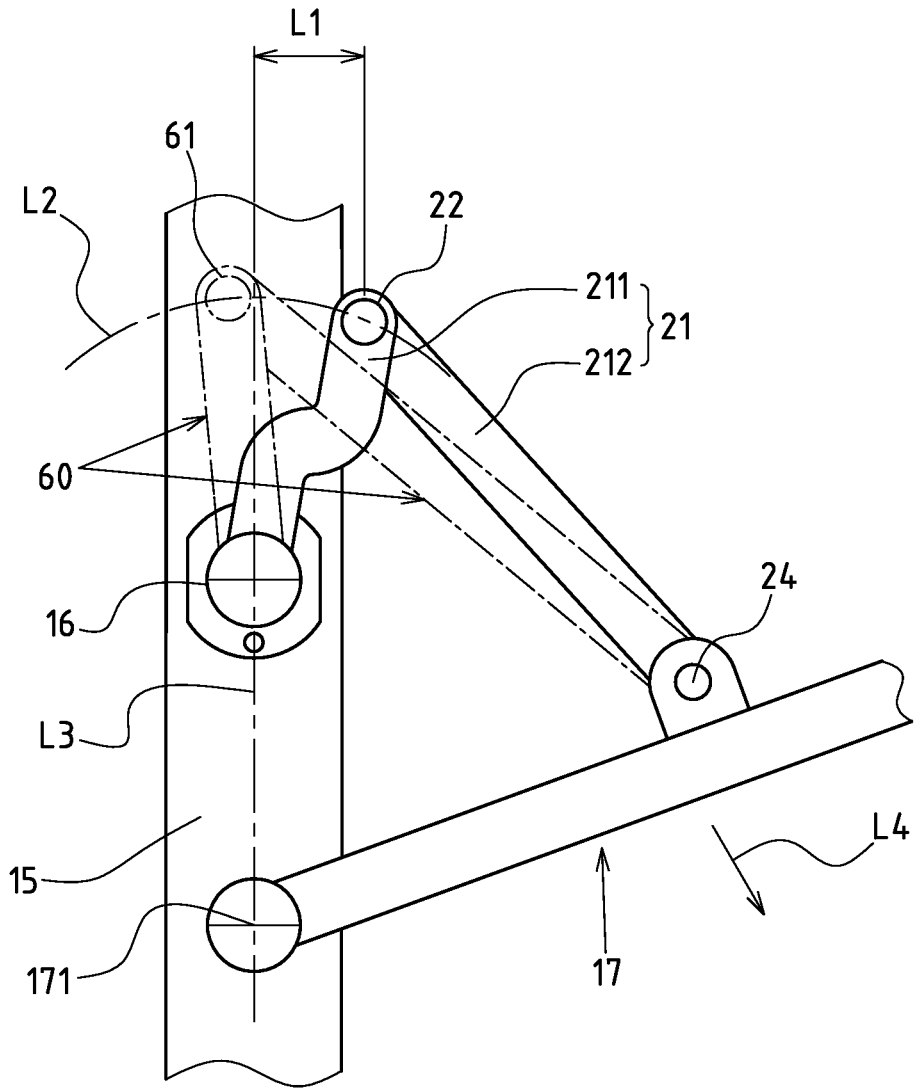
FIG. 8 is a status diagram of the drive connecting rod of the present invention compared with the common elbow-type connecting rod.

Referring to FIG. 8, when the swinging rod 17 swings upwards to the preset biggest swinging angle so that a minimal included angle is formed between the front and rear elbows 211,212 of the drive connecting rod 21, the swinging angle of the front elbow 211 is of a back rake angle without exceeding vertical angle, so as to avoid dead point for driving.

Of which, the front elbow 211 of the drive connecting rod 21 could be formed into a curved pattern. When the swinging rod 17 swings upwards to the preset biggest swinging angle so that a minimal included angle is formed between the front and rear elbows 211,212 of the drive connecting rod 21, the swinging angle of the front elbow 211 is of a back rake angle without exceeding vertical angle. Besides, the pivoting position of the pivotal end 171 of the swinging rod 17 could correspond to the vertical position right below the mandrel 16 at center of the drag wheel 14.

Figure 3:
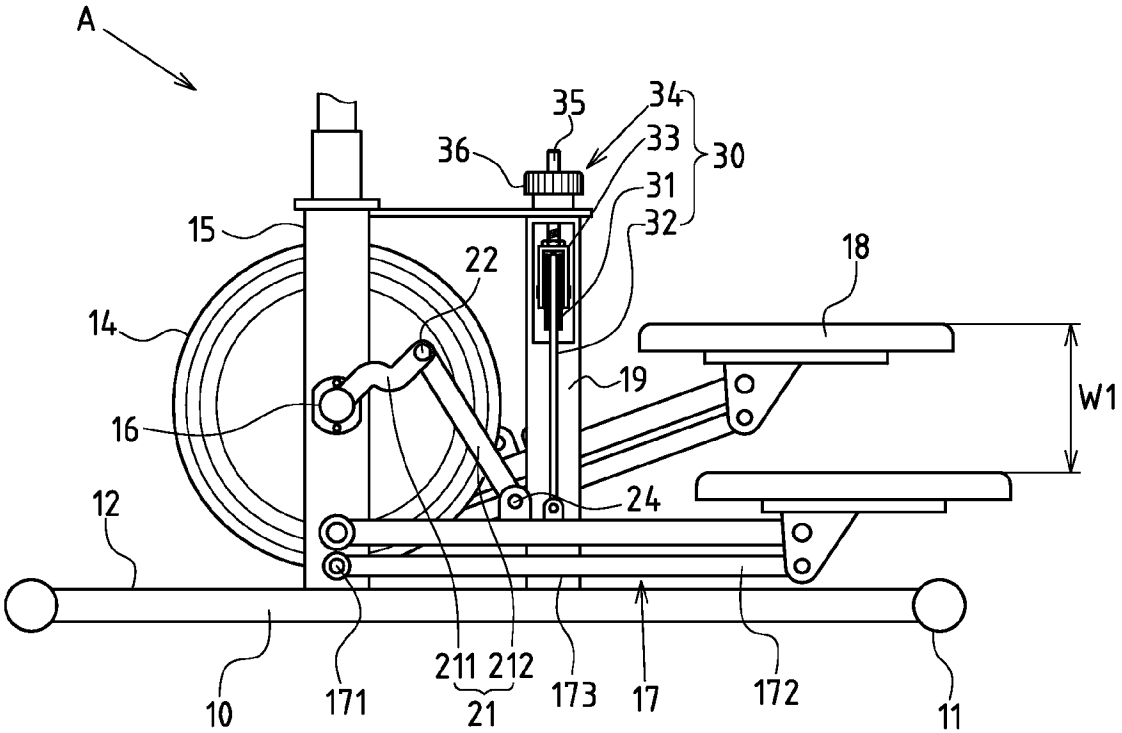
FIG. 3 is a plain sectional view of the stride regulating mechanism of the present invention in the first regulation state.

Referring to FIG. 3, the regulating member 34 of the stride regulating mechanism 30 comprises of a screw stem 35, a regulating nut 36 and a vertical screw hole 37 penetrating the top of the floorstand 19. Of which, the bottom of the screw stem 35 is linked to the top of the lifting base 33, the top of the screw stem 35 is screwed upwards across the vertical screw hole 37 of the floorstand 19 (marked in FIGS. 4, 6); and the regulating nut 36 is screwed at top of the screw stem 35 and abutted onto top of the floorstand 19.

Figure 4:
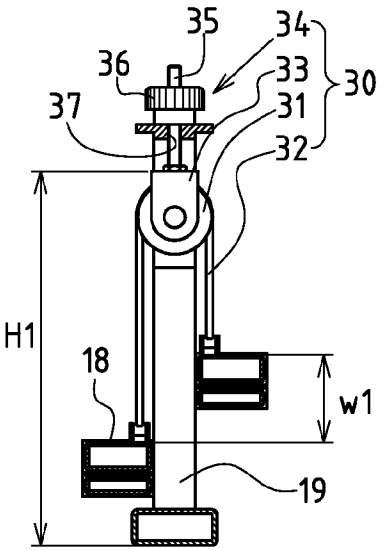
FIG. 4 is a plane sectional view of FIG. 3 from the other side.
Figure 6:
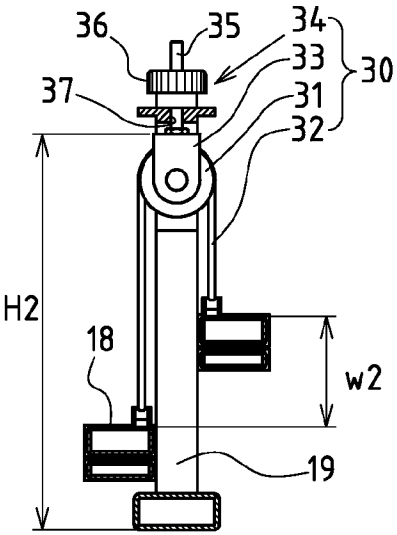
FIG. 6 is a plane sectional view of FIG. 5 from the other side.
Figure 5:
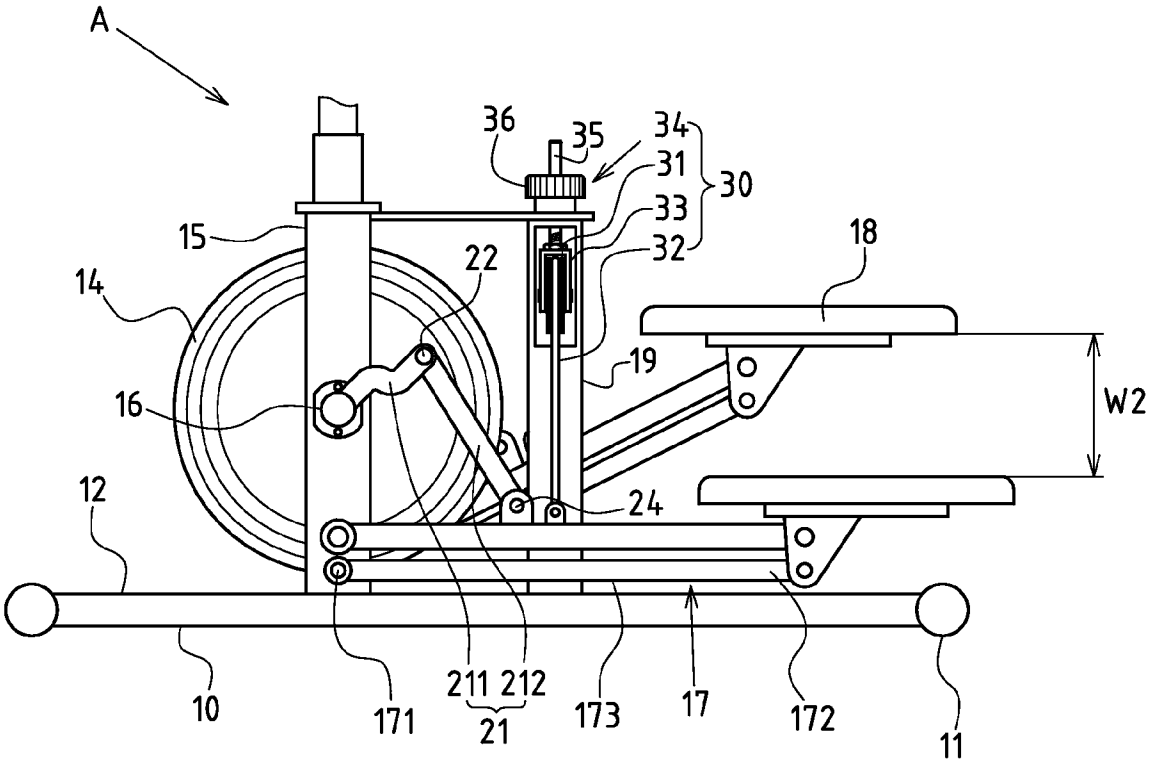
FIG. 5 is a plane sectional view of the stride regulating mechanism of the present invention in the second regulation state.
Figure 7:
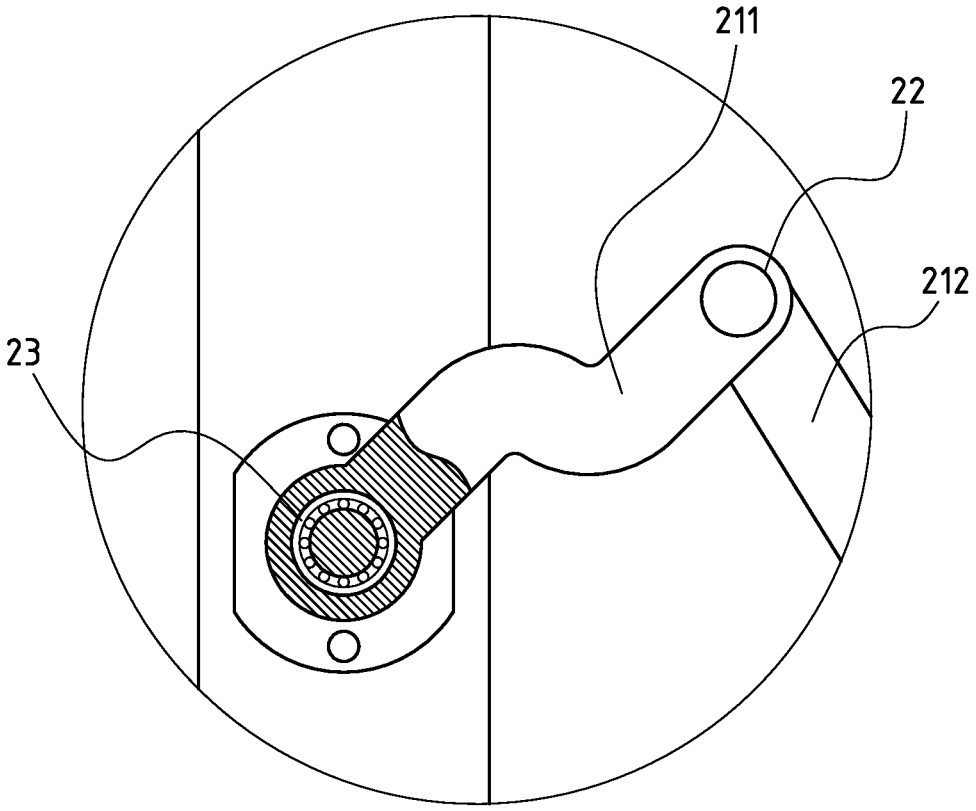
FIG. 7 is an enlarged perspective view of the present invention wherein the one-way bearing sleeving portion is sleeved onto the mandrel of the drag wheel.

Based on above-specified structural design, the present invention is operated as follows:

Referring to FIG. 3, the lifting state of the lifting base 33 could be regulated through the regulating member 34, so the height of the free wheel 31 and double-end pull rope 32 could be changed accordingly to regulate two swinging rods 17 along with maximum stride of two pedals 18. Referring to FIGS. 3 and 4, a plain side view and plain sectional view of the stride regulating mechanism 30 of the present invention in the first regulation state, the user could use a handheld tool (e.g.: wrench) or hold manually to rotate the regulating nut 36 of the regulating member 34 clockwise or counter-clockwise, so that the screw stem 35 moves up and down to drive the lifting base 33 to the first height (indicated by H1), allowing to regulate two swinging rods 17 along with maximum stride of two pedals 18 (indicated by W1, w1). Referring also to FIGS. 5 and 6, a plain side view and plain sectional view of the stride regulating mechanism 30 of the present invention in the second regulation state, the height of two swinging rods 17 along with maximum stride of two pedals 18 could be further regulated in the preferred embodiment, such that the lifting base 33 is located at second highest position (indicated by H2), namely, H2, W2, w2 in FIGS. 5, 6 are bigger than H1, W1, w1 in FIGS. 3, 4, allowing to regulate maximum stride depending on the users' body shape and preference.

FIG. 8 depicts a status diagram of the front elbow 211 of the drive connecting rod 21 compared with a common elbow-type connecting rod. When the user treads the pedal 18, the swinging rod 17 and drive connecting rod 21 will be actuated (with direction indicated by L2), and the front elbow 211 of the drive connecting rod 21 is used to form a curved pattern. So, when the swinging rod 17 swings upwards to the preset biggest swinging angle so that a minimal included angle is formed between the front and rear elbows 211, 212 of the drive connecting rod 21, the swinging angle of the front elbow 211 of the present invention is of a back rake angle without exceeding vertical angle, namely, the pivoted portion 22 is located beyond the central vertical line L3 of the vertical framework 15 (with the spacing indicated by L1). When the swinging rod 17 swings downwards (indicated by arrow L4), it is prone to be compriseent with the actuating direction and path of the drive connecting rod 21 (indicated by L2), so as to avoid the dead point of driving and guarantee more smooth driving (note; the conventional connecting rod 60 will generate dead point and hinder the driving due to sharp difference between the pull-down path of long rod and the swinging path of short rod).

I claim:

1. An improved structure of treadmill, which comprising:

a pedestal, set transversely in an elongated pattern, including: a holding portion and mounting surface;

an arm stand, set vertically onto the mounting surface of the pedestal;

a drag wheel pivoted axially onto the pedestal through a vertical framework; a mandrel is set transversely onto a center of the drag wheel;

two swinging rods and two pedals; of which two swinging rods include a pivotal end, a swinging end and a middle portion located between the pivotal end and swinging end; the pivotal end is pivoted onto the pedestal and located at a spacing on two sides of the drag wheel; moreover, a pivoting location of the pivotal end corresponds to the lower position of the mandrel at center of the drag wheel; two pedals are separately set onto the swinging ends of two swinging rods; moreover, a floorstand is set on said pedestal between two swinging rods;

a stride regulating mechanism, set onto the floorstand, comprising of a free wheel, a double-end pull rope, a lifting base and a regulating member; of which the double-end pull rope is hung onto the free wheel in U shape, and two ends of the double-end pull rope are separately attached to the middle portion of two swinging rods; the free wheel is pivoted onto the lifting base in a rotary state; and the lifting base is suspended onto the floorstand through the regulating member;

two elbow-type drive connecting rods, linked separately to the mandrel and two swinging rods of the drag wheel; said drive connecting rod comprises of a front and a rear elbow; the front and rear elbows are coupled via a pivoted portion; moreover, a one-way bearing sleeving portion is set at front end of the front elbow for sleeving onto the mandrel of the drag wheel; the rear end of the rear elbow is provided with a rear pivoted portion linked to the middle portion of the swinging rod; when two swinging rods swing vertically, the front and rear elbows of the drive connecting rod are driven for inching movement with varying included angle; furthermore, the drag wheel is rotated under one-way drive of the one-way bearing sleeving portion for the mandrel;

when the swinging rod swings upwards to a preset biggest swinging angle so that a minimal included angle is formed between the front and rear elbows of the drive connecting rod, the swinging angle of the front elbow is of a back rake angle without exceeding vertical angle, so as to avoid dead point for driving.

2. The structure defined in claim 1, wherein the regulating member of the stride regulating mechanism comprises of a screw stem, a regulating nut and a vertical screw hole penetrating a top of the floorstand; of which the bottom of the screw stem is linked to a top of the lifting base, the top of the screw stem is screwed upwards across the vertical screw hole of the floorstand; and the regulating nut is screwed at top of the screw stem and, abutted onto top of the floorstand.

3. The structure defined in claim 1, wherein the front elbow of the drive connecting rod is formed into a curved pattern; so when the swinging rod swings upwards to the preset biggest swinging angle so that a minimal included angle is formed between the front and rear elbows of the drive connecting rod, the swinging angle of the front elbow is of a back rake angle without exceeding vertical angle.

* * * * *